US007845969B2

(12) United States Patent
Stadler et al.

(10) Patent No.: US 7,845,969 B2
(45) Date of Patent: Dec. 7, 2010

(54) CONTACT ELEMENT FOR A CONNECTING TERMINAL, CONNECTING TERMINAL, AND PLUG LINK FOR A CONTACT ELEMENT

(75) Inventors: Hermann Stadler, Donaueschingen (DE); Frank Walter, Blumberg (DE)

(73) Assignee: MC Technology GmbH, Blumberg (DE)

( * ) Notice: Subject to any disclaimer, the term of this patent is extended or adjusted under 35 U.S.C. 154(b) by 0 days.

(21) Appl. No.: 12/385,486

(22) Filed: Apr. 9, 2009

(65) Prior Publication Data

US 2009/0269985 A1 Oct. 29, 2009

(30) Foreign Application Priority Data

Apr. 23, 2008 (DE) ..... 10 2008 020 511

(51) Int. Cl.
*H01R 4/24* (2006.01)

(52) U.S. Cl. ..... 439/441

(58) Field of Classification Search ..... 439/441, 439/439, 440, 786, 787, 907, 721, 709, 715, 439/716

See application file for complete search history.

(56) References Cited

U.S. PATENT DOCUMENTS 5,192,234 A * 3/1993 Heng et al. ..... 439/806
5,722,850 A * 3/1998 White ..... 439/404
5,741,161 A * 4/1998 Cahaly et al. ..... 439/709
5,816,867 A * 10/1998 Davidsz et al. ..... 439/828
6,247,961 B1 * 6/2001 McCoy ..... 439/439
6,368,128 B1 * 4/2002 Backer et al. ..... 439/189
6,464,545 B2 * 10/2002 Yano ..... 439/828
6,570,306 B2 * 5/2003 Henrici et al. ..... 313/318.01
6,682,364 B2 * 1/2004 Cisey ..... 439/441
6,786,779 B2 * 9/2004 Feldmeier et al. ..... 439/729
D499,072 S * 11/2004 Walter ..... D13/147
7,114,986 B1 * 10/2006 Toly ..... 439/441
7,175,469 B1 * 2/2007 Daily et al. ..... 439/441
7,285,006 B1 * 10/2007 Daily et al. ..... 439/441
7,329,143 B2 * 2/2008 Schrader ..... 439/441

(Continued)

FOREIGN PATENT DOCUMENTS

DE 43 33 263 C2 3/1995

(Continued)

OTHER PUBLICATIONS

Extended European Search Report issued Oct. 5, 2010, in counterpart European Application No. 09001431.7, six (6) pages.

*Primary Examiner*—T C Patel
*Assistant Examiner*—Vladimir Imas
(74) *Attorney, Agent, or Firm*—The Nath Law Group; Jerald L. Meyer; Robert T. Burns

(57) ABSTRACT

The invention relates to a contact element for a connecting terminal, where the contact element consists of a bent punched part, into which are integrated at least an initial clamping means for fixing a plug link into position and a second clamping means for fixing a connecting pin into position. The invention also relates to a connecting terminal, particularly a circuit board connecting terminal, with at least two clamping elements, where the clamping elements each have an insulating housing, with a contact element of the described type positioned within said insulating housing. Finally, the invention relates to a plug link for such a connecting terminal.

14 Claims, 6 Drawing Sheets

U.S. PATENT DOCUMENTS

| | | | | |
|---|---|---|---|---|
| 7,344,422 | B2 * | 3/2008 | Helmreich | 439/835 |
| 7,357,665 | B1 * | 4/2008 | Yan | 439/500 |
| 7,384,317 | B1 * | 6/2008 | Pijoan Parellada et al. | 439/814 |
| 7,384,319 | B2 * | 6/2008 | Kirstein et al. | 439/839 |
| 7,410,386 | B2 * | 8/2008 | Fabian et al. | 439/441 |
| 7,462,076 | B2 * | 12/2008 | Walter et al. | 439/709 |
| 7,470,143 | B2 * | 12/2008 | Osborn et al. | 439/441 |
| 7,507,107 | B2 * | 3/2009 | Tuerschmann et al. | 439/441 |
| 7,530,837 | B2 * | 5/2009 | Nieleck et al. | 439/441 |
| 7,544,103 | B2 * | 6/2009 | Walter et al. | 439/709 |
| 2004/0043670 | A1 * | 3/2004 | Feldmeier et al. | 439/709 |
| 2007/0099480 | A1 * | 5/2007 | Fabian et al. | 439/441 |
| 2007/0141893 | A1 * | 6/2007 | Pizzi | 439/441 |
| 2007/0238303 | A1 * | 10/2007 | Walter et al. | 438/709 |
| 2007/0249215 | A1 * | 10/2007 | Osborn et al. | 439/441 |
| 2008/0032566 | A1 * | 2/2008 | Walter et al. | 439/721 |

FOREIGN PATENT DOCUMENTS

| | | | |
|---|---|---|---|
| DE | 195 06 859 | A1 | 8/1996 |
| DE | 195 47 557 | A1 | 6/1997 |
| DE | 197 10 422 | C1 | 8/1998 |
| DE | 198 03 085 | A1 | 8/1999 |
| DE | 299 10 867 | U1 | 11/1999 |
| DE | 299 17 825 | U1 | 2/2001 |
| DE | 299 17 825 | U1 | 3/2001 |
| DE | 100 13 241 | A1 | 9/2001 |
| DE | 10 2007 024 661 | A1 | 11/2007 |
| EP | 0 307 580 | A2 | 3/1989 |

* cited by examiner

CONTACT ELEMENT FOR A CONNECTING TERMINAL, CONNECTING TERMINAL, AND PLUG LINK FOR A CONTACT ELEMENT

FIELD

The invention relates to a contact element for a connecting terminal, particularly a circuit board connecting terminal, and to a connecting terminal and to a plug link.

BACKGROUND

As understood in this document, a connecting terminal generally has several poles, to each of which a connecting lead can be attached in order to further transmit an electrical signal, specifically by clamping the lead to a contact element and fixing it in position there. As a rule, the electrical signal is then received from the contact element by one or more permanent or detachable electrical connections. Each pole of a connecting terminal thus corresponds to a clamping element, and the entire connecting terminal is constructed of a plurality of such clamping elements.

When connecting terminals are used to connect more than one connecting lead, and when circuit board connecting terminals, in particular, are used to connect a plurality of leads to circuit boards, it is often the case that two or more clamping elements must be electrically connected to each other in the connecting terminal. This is usually achieved by inserting a lead component that is bent into the shape of a U, or a stamped or punched part that has a U-shape, into the clamping point, where it is clamped into position. However, a problematic aspect of this procedure rests in the fact that an additional connecting lead must be attached to least one of the connected clamping points, which means that two elements must be clamped into position at this point. The result is that a secure contact for the two elements cannot be absolutely guaranteed, e.g., because the diameter of the U-shaped lead component or stamping may diverge from that of the connecting lead. Spring clamps, which are widely employed because of their unusually robust, economical, and easily handled clamping mechanism have proved to be particularly susceptible in this regard.

DE 10 2004 013 757 shows a way of circumventing this problem by installing separate electrical contacts when clamping elements of this kind must be linked together. Installation must be performed in advance, however. Moreover, the connection cannot be undone once it is made, and assembly costs consequently rise.

SUMMARY

The goal of the invention, therefore, is to provide a contact element for a connecting terminal, particularly a circuit board connecting terminal, as well as to provide a connecting terminal itself and a plug link for the connecting terminal, such that the poles of the connecting terminal can be connected in a manner that flexible, well-adapted to the market, and cost-effective.

The invention achieves this goal with a contact element for a connecting terminal with the features of patent claim 1, with a connecting terminal with the features of patent claim 8, and with a plug link for a connecting terminal with the features of patent claim 13. Advantageous embodiments and elaborations of the invention are indicated in the secondary claims.

The basic idea of the invention is to design the contact element for a connecting terminal as a bent punched part, into which are integrated at least an initial clamping means for fixing a plug link in place and a second clamping means for fixing a connecting pin in place. "Integrated" is understood to mean specifically that the first and the second clamping means are integral parts of the bent punched part and that the corresponding sections of the bent punched part are provided by suitable mechanical pre-stressing, when necessary.

In this way, a separate clamping contact is provided for a plug link, by means of which different contact elements can be shorted with each other, while an optimal clamping effect for the pin and electrical conductors is simultaneously guaranteed at all the clamping contacts.

The multi-functional contact element elaborated by the invention can be produced simply and economically in a single step, namely by producing the bent punched part.

The bent punched part has an advantageous cage-like structure, which makes it possible, e.g., to close a flow of power that is introduced into the contact element by an additional clamping spring, which is positioned as a separate part in the contact element.

Contact elements have proven to be particularly suited when at least the first clamping means is flat, since this permits a particularly compact, space-saving design. It has proven to be particularly useful if the first clamping means has at least one leg, which clamps into position a contact finger that belongs to a plug link and that is inserted between the clamping leg and a wall or a second clamping leg.

An embodiment of the first clamping means which ensures a particularly secure clamping connection specifies that at least one clamping leg has a structural feature, e.g., an indentation or a bulge, that engages with a matching bulge or indentation belonging to a contact finger. Clamping means of this kind can be very simply provided by punching out the appropriate shape from strips of sheet metal.

A wide range of application for a single design of the contact element is provided if the second clamping means is so designed that the connecting pin can be inserted from three different spatial directions.

The contact element can be further improved if it also has a contact surface for testing, such as to permit the signal applied to this structural component to be tested.

The connecting terminal according to the invention, and the circuit board connecting terminal, in particular, has at least two clamping elements, each of which has an insulating housing and a contact element (as also specified by the invention), which is positioned inside the insulating housing.

It is particularly advantageous if the insulating housing of at least two of the clamping elements, specifically the clamping elements which are connected together in electrically conductive fashion, has a lead-insertion hole, a plug-link insertion hole that is separated from the lead-insertion hole, and at least one other hole for producing a plug contact with a pin or a multi-pin connector. This ensures that for each plug contact that is provided there can be an individual clamping point that is adapted to the special demands of the given plug contact.

It has also proved to be advantageous if the insulating housing has at least one locking device with click-in means which allow the insulating housing to be secured to a housing or circuit board.

For a variable electrical connection, which permits subsequent modification and which involves at least two clamping elements belonging to this kind of connecting terminal, a plug link is particularly suited—specifically, a plug link which, when inserted, is clamped by the first clamping means of the given contact element.

The plug link for a contact element according to the invention advantageously has a front part and at least two contact fingers. The plug link is particularly easy to handle when the front part is at least partially angled. In order to remove the plug link without danger, for all voltages applied to the contact element at a given moment, it very useful if the front part is at least partially covered with an insulation. The insulting cover may be an applied plastic or an injection-molded part.

A particularly secure seat for the plug link can be provided if at least one of the contact fingers has a bulge or indentation, so that a locking effect is provided with the assigned clamping means, and specifically when said clamping means has a corresponding indentation or bulge.

It also contributes to the secure seat if at least one of the contact fingers has an opening, since in this way the rims of the contact fingers will yield elastically in relation to each other and thereby provide a better contact.

It is expedient if the plug link is also designed as a bent punched part, and if it has a U-shape when the link is a bipolar one and a comb-shape when the link is a multi-polar one.

BRIEF DESCRIPTION OF THE DRAWINGS

An exemplary embodiment of the invention is next described in detail on the basis of the figures. Shown are.

Unless otherwise noted, identical reference numerals are used for identical components in all of the figures.

DETAILED DESCRIPTION

Figure 1:
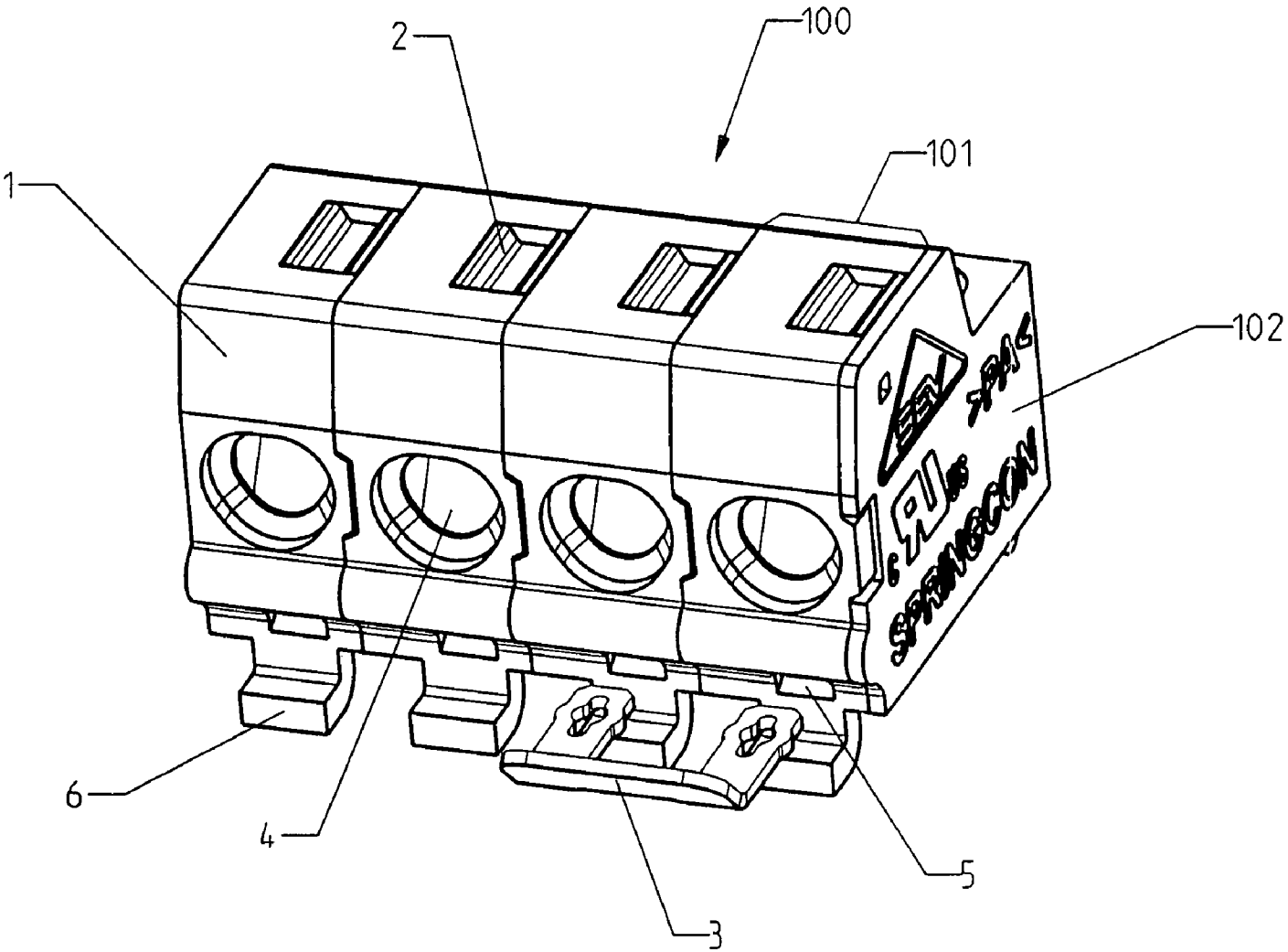
FIG. 1 a view of the connecting terminal according to the invention, with an unplugged plug link FIG. 2 a view of the connecting terminal according to FIG. 1, with a removed lateral wall and an inserted plug link FIG. 3 a cross-section through the connecting terminal according to FIG. 1

FIG. 1 gives a view of a connecting terminal 100 according to the invention and of an unplugged plug link 3. The connecting terminal 100 shown in FIG. 1 is designed for four connection wires or leads which are not depicted, though a design that accommodates more or fewer connection leads is also possible. Providing the connecting terminal with a modular design, consisting of individual clamping elements 101 that can be joined together, is particularly suitable, though an inseparable design is also possible.

Each clamping element 101 has an insulating housing 1, which as a rule is made of an electrically insulating material; it also has a lead-insertion hole 4, a plug-link insertion hole 5, and a pressing component 2, which is also generally produced from an electrically insulating material and runs through the insulating housing 1.

The insulating housing 1 also has at least one locking device 6, which engages with a circuit board or the wall of a housing. On its side the connecting terminal 100 is sealed with a lateral wall 102.

Figure 2:
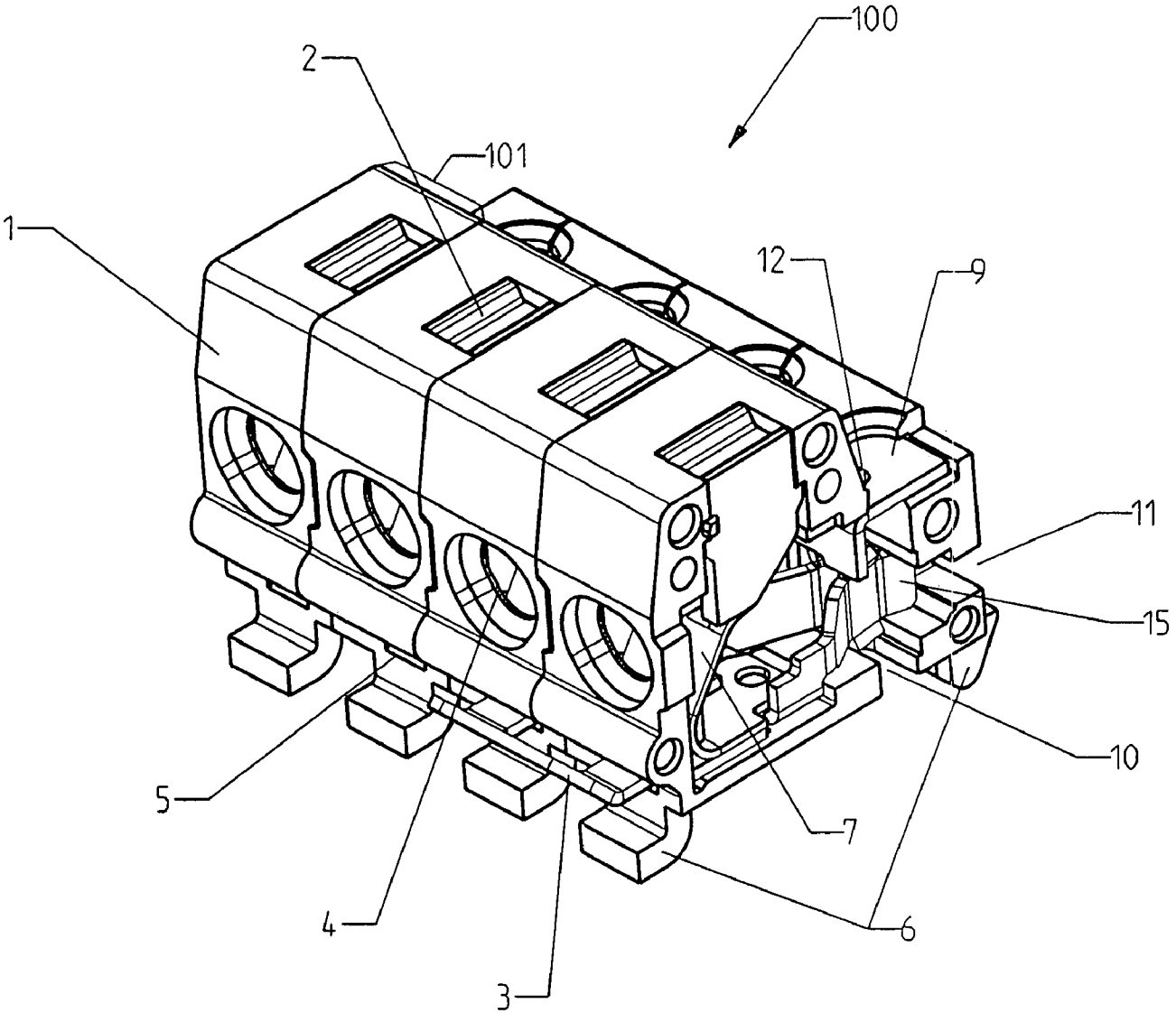

FIG. 2 gives a view of the connecting terminal 100 of FIG. 1. The connecting terminal 100 is composed of four clamping elements 101, and its lateral wall 102 is removed to provide a view into the interior of one of the clamping elements 101. In addition to the lead-insertion hole 4, the plug-bridge insertion hole 5, and the pressing components 2 that penetrate the insulating housing, the insulating housing 1 also has three holes 10, 11, 12 for plug contacts that are not depicted. Positioned in the interior of the insulating housing 1 is a contact element 8, which is accessible from the outside via a testing tap 9.

Figure 4:
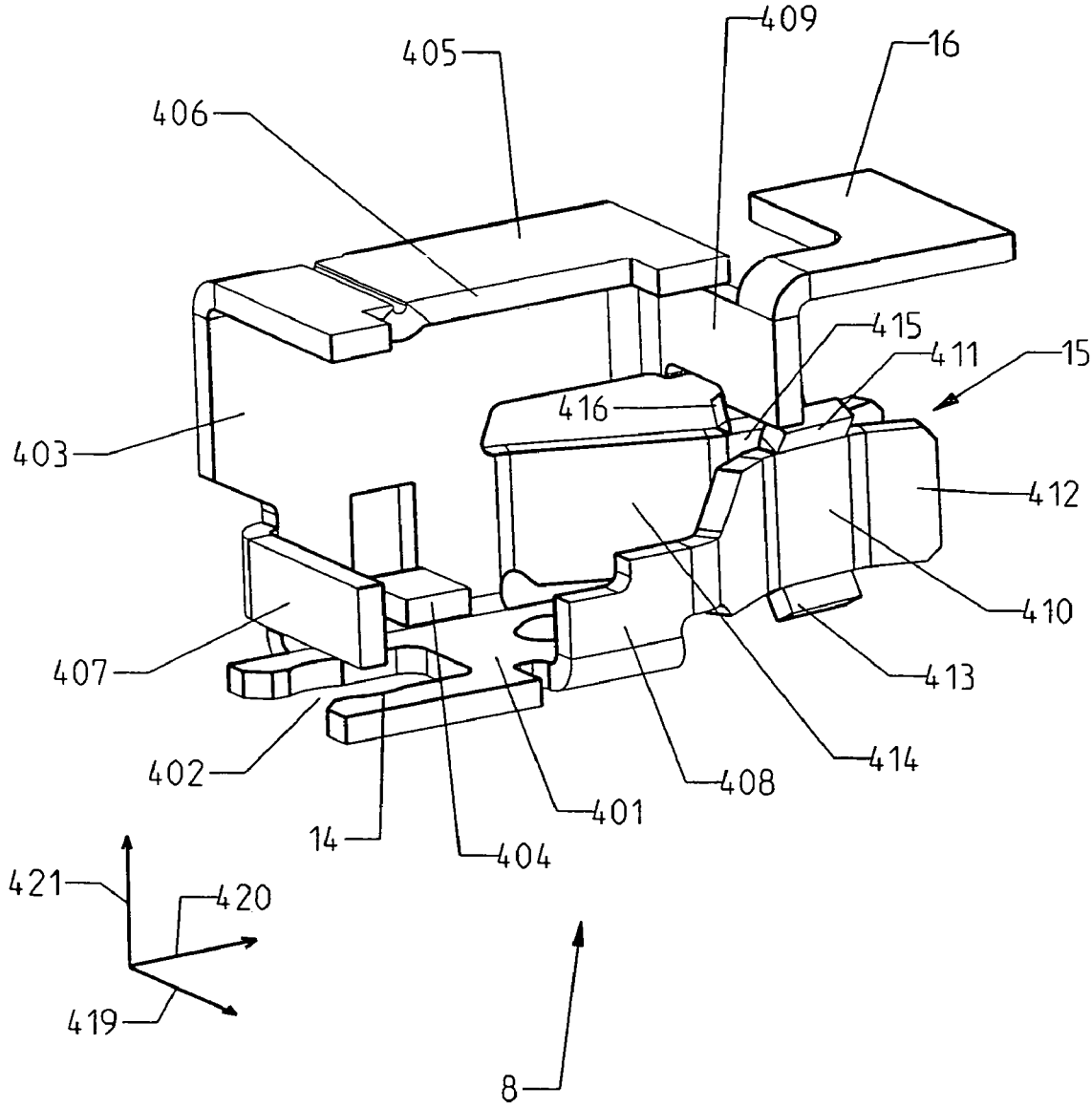
FIG. 4 an exemplary embodiment of a contact element for the connecting terminal according to FIG. 1, in detail FIG. 5 an exemplary embodiment of a plug link for a connecting terminal according to FIG. 1, in detail FIG. 6 a view from below of two adjacent contact elements belonging to a connecting terminal according to FIG. 1, as connected by an inserted plug link.

FIG. 4 shows an exemplary embodiment of the contact element 8 belonging to the connecting terminal 100 of FIG. 1. The contact element 8 is designed as a single-piece bent punched part. The contact element 8 is also designed in the shape of a cage. It is essential to the invention that there is incorporated into the contact element 8 an initial clamping means 13 and a second clamping means 15, which specifically form a single piece with said contact element 8 and are integral to it. In the embodiment shown in FIG. 4 the first clamping means 13 comprises two clamping legs with an indentation 14. The second clamping means 15 is designed as a contact spring, which has insertion aids 22 running in three directions; these insertion aids 22 facilitate the creation of a clamping contact with a connection pin (not shown), which is introduced from these directions. In addition, the contact element 8 in the embodiment shown in FIG. 4 has a testing contact surface 16, which is accessible from the testing tap 9. The testing contact surface 16 provided on the contact element 8 allows the current and voltage conditions that obtain on the contact element 8 at a given time to be tapped by means of the testing tap 9 and allows a measurement to be made.

The bent punched part that forms the cage-like structure of the contact element 8 shown in FIG. 4 is specifically composed as follows: with its crosswise dimension a base plate 401 describes an x-axis 419, and with its longitudinal dimension a y-axis, and with its dimension with respect to thickness a z-axis, and these axes jointly form a right-handed Cartesian coordinate system. In the coordinate system thus defined, "forward" corresponds to larger x-values and "backwards" to smaller ones; "right" to larger y-values and "left" to smaller ones; and "upper" to larger z-values and "lower" to smaller ones.

At the border of the left rim of the base plate 401 there is a stamped out area 402 that produces the first clamping means 13, which here takes the form of clamping legs, with recesses 14 provided in its interior.

Running from the right part of the front rim of the base plate 401, basically parallel to the y-axis, there is a first material strip 408, which extends further to the right across the right rim of the base plate 401 and which is bent upwards around an axis running basically parallel to the y-axis. The part of the first material strip 408 that borders the base plate 401 serves to laterally stabilize the elastic spring (not shown in FIG. 4) in the forward direction. As the material strip 408 extends further to the right, it first runs diagonally backwards and passes into a rectangular clamping area or surface 410, which runs basically parallel to the y-axis. This clamping surface 410 is surrounded in the remaining three directions by areas 411, 412, 413, which are tilted diagonally and forwards, relative to the clamping surface 410. This portion of the first material strip 408 forms the first part of the clamping means 15; another material strip 414, whose shape in described below, forms the second part of the clamping means 15.

Figure 3:
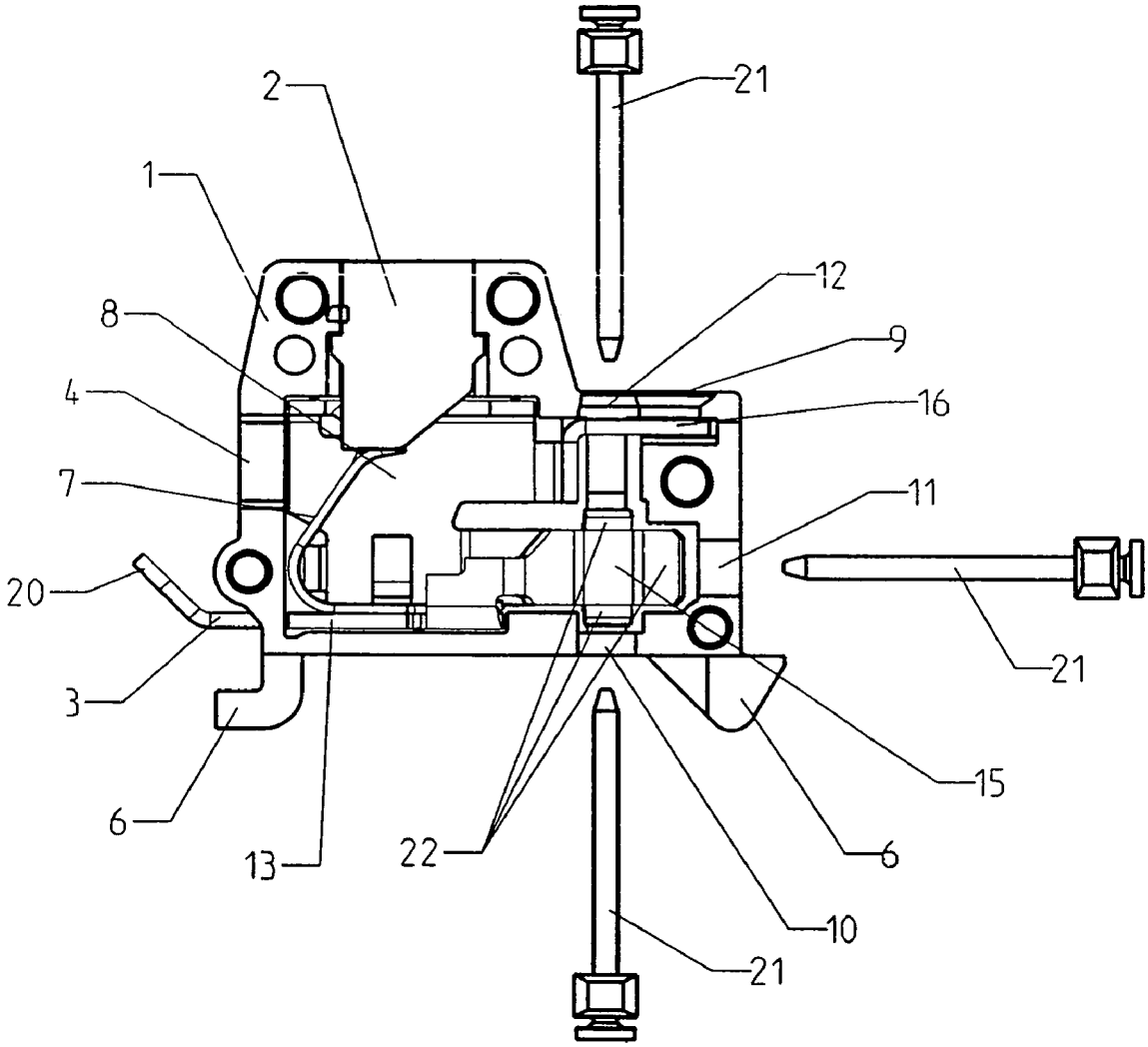

Bent forward from the upper rear wall 403, which runs basically parallel to the y-axis, is a top plate 405, which extends along the x-axis basically parallel to the base plate 401. The lead (not shown) comes to rest on the side of the top plate 405 that faces the base plate 401 when said lead is inserted and is positioned by a clamping spring 7, which is shown only in FIGS. 1 and 3. Positioned on the front rim of the top plate 405 there is a rectangular stamped out area 406, which serves to receive the pressing component 2, which is shown in FIGS. 1 to 3.

In the left lower area of the back wall 403, a third material strip 407 is bent forward so that it runs parallel to the x-direction and so that the front rim of the base plate 401, the front rim of the third material strip 407, and the front rim of the top plate 405 lie on a single plane; at the same time, the left rim of the base plate 401, the left rim of the third material strip 407, and the left rim of the top plate 405 lie on a single plane. The material strip 407 serves to secure the clamping spring 7 (not depicted) when the contact element 8 is pushed in too far to the right.

In the right upper area of the back wall 403 a fourth material strip 409 is bent forward so that it runs parallel to the x-direction and so that the front rim of said fourth material strip 409 and of the top plate 405 lie on a single plane [sic]. The fourth material strip 409 serves as a support for the testing contact surface 16, which is bent away from, and to the right of, said fourth material strip 409 on the latter's front rim, so that the testing contact surface 16 rests basically parallel to the top plate 405 and lies on the same plane as the latter, or slightly below it.

The fifth material strip 414, already mentioned, extends, at first diagonally, from the right lower area of the back wall 403 and to the right. Along the y-coordinate of the left boundary line of the first clamping area 410 of the first material strip 408, the fifth material strip 414 passes into a rectangular second clamping area 415, which is parallel to the first clamping area and of equal size. This second clamping area 415 is surrounded in the remaining three directions by surfaces 416, 417, 418, which run diagonally and backwards. Surfaces 411 and 416, 412 and 417, and 413 and 418 each form a common insertion aid for inserting a connecting pin 21 (not shown) into the second clamping means 15 formed by material strips 408 and 414, and specifically for inserting said connecting pin 21 between the clamping area 410 and 415.

Again with reference to FIG. 2, the clamping spring 7 in the contact element 8, is so inserted between the base plate 401 and the top plate 405 of the contact element 8 (or as the case may be, between the base plate 401 of the contact element 8 and the bottom of the pressing component 2) that a clamping effect can be exerted on a connecting lead (not shown) that is inserted into the lead-insertion hole 4. The clamping spring 7 forms the third clamping means of the connecting terminal 100. Visible in the rear area of the contact element 8 is the second clamping means 15, which forms a single piece with said contact element 8.

A plug link 3 is inserted into the two adjacent plug-link insertion holes 5 belonging to two adjacent clamping elements 101, and the two clamping elements 101 are then joined together in electrically conductive fashion by this plug-link 3. It is understood that the plug link 3 can also be designed so that more than two clamping elements 101 are connected in conductive fashion or that two non-adjacent clamping elements 101 are joined together.

The basic principle according to which terminal leads are connected through use of the connecting terminal can easily be understood from FIG. 2. When a connecting lead (not shown) with a stripped end is inserted through the lead-insertion hole 4 and into the interior of a clamping element 101 it meets the blade-like front side (leading diagonally and upwards) of the clamping spring 7 and is thereby guided diagonally and upwards until it meets the actual supporting surface, formed by the inside area of the cover plate 405, of the contact element 8 (not depicted in FIG. 2). When the connecting leads are sufficiently rigid, the exertion of further pressure causes the clamping spring 7 to be slightly depressed, and the stripped end of the connecting lead is squeezed between the supporting surface and the clamping spring 7. When less rigid connecting leads are used, the clamping spring 7 can also be pressed down by pressure exerted on the pressing component 2, which rests against a shoulder or contact surface of the clamping spring 7. The connecting lead is then inserted and clamped into position when pressure on the pressing component 2 is released. In both cases, the connection is cancelled when pressure is exerted on the pressing element 2, so that the clamping spring 7 is depressed and its clamping effect is negated. When the clamping spring 7 is in a depressed state, the connecting lead can be easily removed.

The contact element 8 is made of an electrically conductive material. Electrical signals fed by a connecting lead inserted into the clamping element 101 will therefore disperse through the contact element 8, specifically into the contact spring for the plug contact. Using holes 10, 11 and/or 12, a plug contact can be produced with the second clamping means 15, which is designed as a contact spring, and from three different directions, simply by inserting an electrically conductive connecting pin into the contact spring.

FIG. 3 provides a cross-section through the connecting terminal 100 of FIG. 1. In addition to elements that are familiar from FIGS. 1 and 2, this depiction shows further details, specifically with regard to the position of the clamping spring 7 in the contact element 8.

Figure 5:
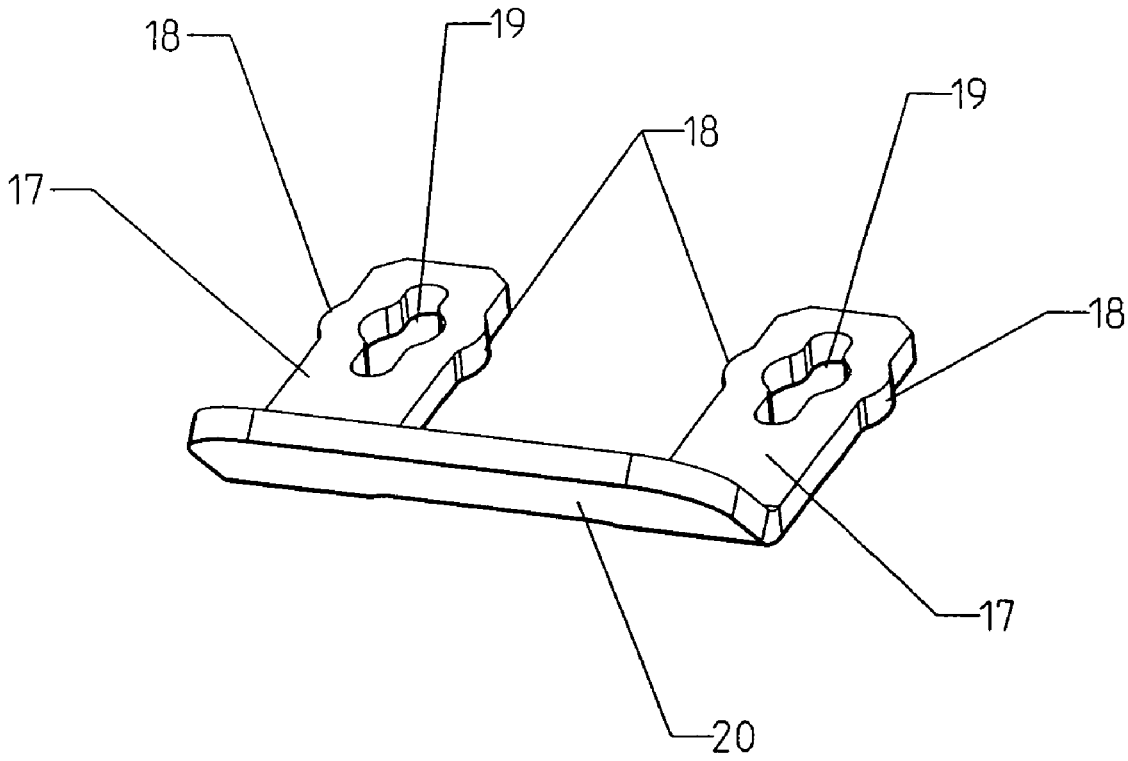

FIG. 5 shows an exemplary embodiment of the detailed structure of the plug link 3, which is designed to particular advantage as a bent punched part. It has an angled front portion 20, which is advantageous, and from it extend two contact fingers 17. In principle, the contact fingers 17 may lie in the same plane as the front part 20, but the angled design facilitates manipulation, particularly the removal of the plug link 3. The number of contact fingers can also be larger, so that a comb-like structure is produced. The inserted plug link 3 is fixed in position by a reciprocal clamping effect with the first clamping mean 13, which is integrated into the contact element 8 (compare FIG. 3). A secure seat for the plug link 3 upon insertion is achieved, in particular, by the provision of bulges 18, which engage with the indentations 14 of the first clamping means 13 belonging to the contact element 8 (shown in FIG. 4) when the plug link is inserted, and by a recess 19, which improves the elasticity of the rims of the contact fingers 17 and thus improves the contact itself. The front part 20 and the contact fingers 17 will be made, as a rule, from an electrically conductive material; however, the front part 20 can be enclosed, at least in part, by an insulating layer (not shown).

Figure 6:
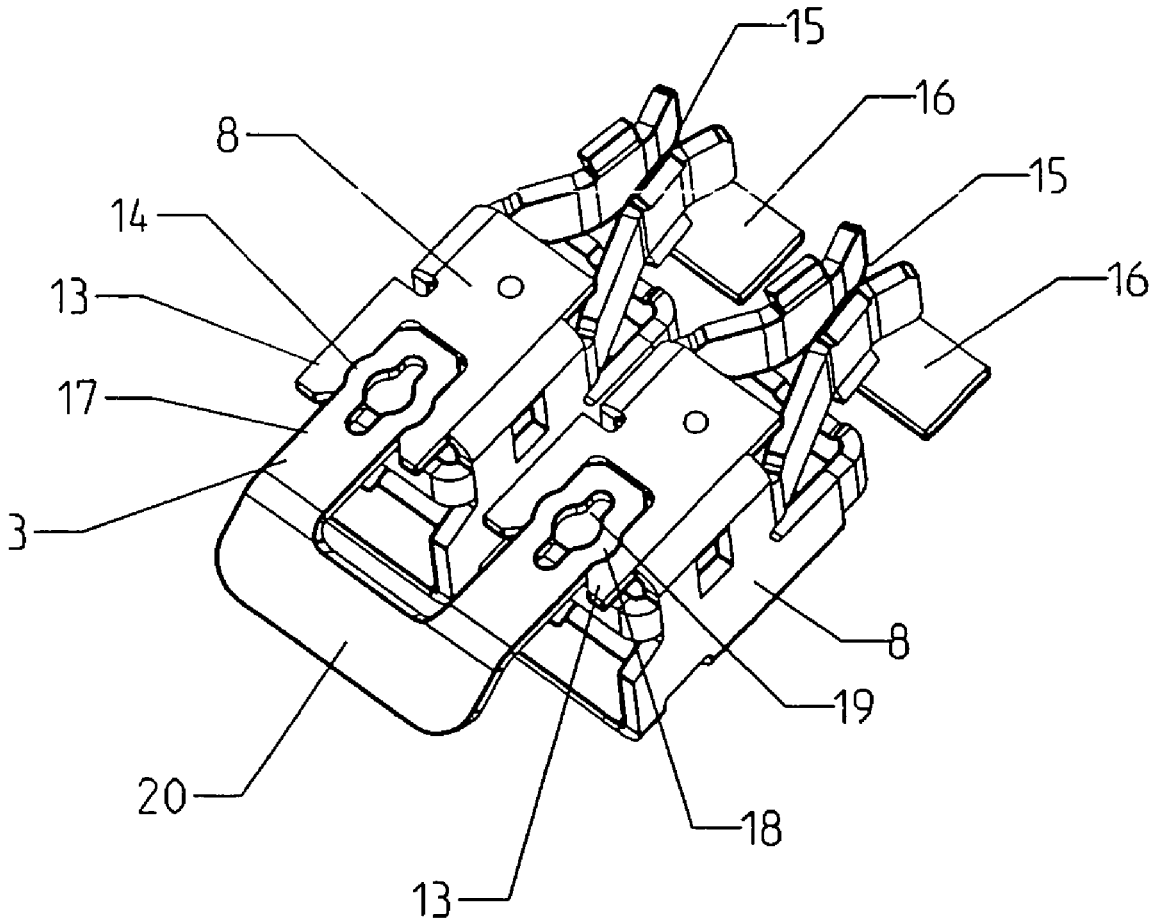

FIG. 6 gives a view from below of two contact elements 8 according to FIG. 4, which lie adjacent to each other, but are spaced at a slight distance. The contact elements 8 belong to a connecting terminal and are joined by an inserted plug link 4. This perspective view from below clearly shows the contact legs which create the first clamping means 13 and the indentation 14. Also clearly visible are the second clamping means 15, in the form of a contact spring for the plug contact, and the testing contact areas 16.

FIG. 6 shows with particularly clarity the interaction between the contact legs 13 of the contact elements 8, including the indentations 14, on the one hand, and the contact fingers 17, including the bulge 18 and the recess 19, on the other hand, to thereby ensures a secure but also reliably detachable connection between the contact elements 8 via the plug link 3. An essential feature here is that the first clamping means 13 is designed to be separate from the second clamping means 15 and also separate from the third clamping means, which takes the form of clamping spring 7, in order to reliably position the plug link 3, independent of the positioning of the connecting pin 21 using the clamping means 5 and independent of the positioning of the connecting lead using the clamping spring 7.

LIST OF REFERENCE NUMERALS

1 insulating housing
2 pressing component
3 plug link
4 lead insertion hole
5 plug-link insertion hole
6 locking device
7 clamping spring
8 contact element
9 testing tap
10 hole for plug contact with pin
11 hole for plug contact with pin
12 hole for plug contact with pin
13 first clamping means
14 indentation
15 second clamping means
16 testing contact surface
17 contact finger
18 bulge
19 recess
20 angled front part
21 connecting pin
22 insertion aid
100 connecting terminal
101 clamping element
102 lateral wall
401 base plate
402 stamping
403 back wall
404 material strip
405 top plate
406 stamping
407 material strip
408 material strip
409 material strip
410 clamping surface
411 surface
412 surface
413 surface
414 material strip
415 clamping surface
416 surface
417 surface
418 surface
419 x-axis
420 y-axis
421 z-axis

The invention claimed is:

1. A connecting terminal, comprising:

at least two clamping elements, such that the clamping elements each have an insulating housing;

a contact element positioned within the insulating housing; and a third clamping means for fixing into position a connecting lead, wherein the contact element further comprises a base plate having a stamped-out area defining a first clamping surface having first and second clamping legs;

a first recess in the interior of the first clamping leg;

a second recess in the interior of the second clamping leg;

a first material strip connected to the base plate extending along a first axis of the base plate and bent in a direction of a second axis perpendicular to the first axis;

a second clamping surface joining with the first material strip and running parallel to the second axis;

a third clamping surface joining with the first material strip opposite the second clamping surface and running parallel to the second clamping surface; and first, second, and third clamping means defined by the first, second, and third clamping surfaces, the first, second, and third clamping means extending in at least two mutually perpendicular directions.

2. The connecting terminal according to claim 1, wherein the contact element has a cage-shaped structure.

3. The connecting terminal according to claim 1, wherein the contact element further comprises a connecting pin configured for insertion in at least one of three different directions.

4. The connecting terminal according to claim 1, wherein the contact element has a testing contact area.

5. The connecting terminal according to claim 1, wherein the insulating housing of at least two of the clamping elements has a lead-insertion hole, a plug-link insertion hole that is separated from the lead-insertion hole, and at least one other hole for producing a plug contact with a connecting pin or multi-pin connector.

6. The connecting terminal according to claim 1, wherein the insulating housing has at least one locking or click-in device.

7. The connecting terminal according to claim 1, wherein the contact elements consisting of at least two clamping elements can be connected together by a plug link.

8. The connecting terminal according to claim 7, wherein the plug link, when inserted, is in each case connected to the first clamping means of the contact element by clamping.

9. A contact element, comprising:

a base plate having a stamped-out area defining a first clamping surface having first and second clamping legs;

a first recess in the interior of the first clamping leg;

a second recess in the interior of the second clamping leg;

a first material strip connected to the base plate extending along a first axis of the base plate and bent in a direction of a second axis perpendicular to the first axis;

a second clamping surface joining with the first material strip and running parallel to the second axis;

a third clamping surface joining with the first material strip opposite the second clamping surface and running parallel to the second clamping surface;

first, second, and third clamping means defined by the first, second, and third clamping surfaces, the first, second, and third clamping means extending in at least two mutually perpendicular directions; and a plug link having a front part and at least two contact fingers, wherein the front part is at least partially insulated.

10. The contact element according to claim 9, wherein the front part of the plug link is at least partially angled off.

11. The contact element according to claim 9, wherein the plug link insulation is a plastic attachment or an extruded coating.

12. The contact element according to claim 9, wherein at least one of the plug link contact fingers has a bulge or an indentation.

13. The contact element according to claim 9, wherein at least one of the plug link contact fingers has a recess.

14. The A contact element, comprising:

a base plate having a stamped-out area defining a first clamping surface having first and second clamping legs;

a first recess in the interior of the first clamping leg;

a second recess in the interior of the second clamping leg;

a first material strip connected to the base plate extending along a first axis of the base plate and bent in a direction of a second axis perpendicular to the first axis;

a second clamping surface joining with the first material strip and running parallel to the second axis;

a third clamping surface joining with the first material strip opposite the second clamping surface and running parallel to the second clamping surface;

first, second, and third clamping means defined by the first, second, and third clamping surfaces, the first, second, and third clamping means extending in at least two mutually perpendicular directions; and a plug link having first and second bulges shaped to fit the first and second clamping leg recesses respectively, wherein the plug link lies in a single plane with the first and second clamping legs and the first and second bulges engage with the first and second clamping leg recesses on the same single plane.

* * * * *